US005407895A

United States Patent [19]

Egashira et al.

[11] Patent Number: 5,407,895

[45] Date of Patent: Apr. 18, 1995

[54] IMAGE RECEIVING SHEET

[75] Inventors: Noritaka Egashira; Koichi Ashahi; Masanori Akada; Yoshinori Nakamura; Kazunobu Imoto; Nobuhisa Nishitani, all of Tokyo, Japan

[73] Assignee: Dai Nippon Insatsu Kabushiki Kaisha, Japan

[21] Appl. No.: 282,326

[22] Filed: Jul. 29, 1994

Related U.S. Application Data

[60] Division of Ser. No. 943,474, Sep. 11, 1992, Pat. No. 5,362,701, which is a continuation of Ser. No. 614,213, Nov. 15, 1990, Pat. No. 5,166,127, which is a division of Ser. No. 320,623, Mar. 8, 1989, Pat. No. 4,992,413.

[30] Foreign Application Priority Data

| | | | |
|---|---|---|---|
| Mar. 11, 1988 | [JP] | Japan | 63-57990 |
| Mar. 11, 1988 | [JP] | Japan | 63-57991 |
| Mar. 11, 1988 | [JP] | Japan | 63-57992 |
| Mar. 11, 1988 | [JP] | Japan | 63-57993 |
| Mar. 11, 1988 | [JP] | Japan | 63-57994 |
| Apr. 18, 1988 | [JP] | Japan | 63-95288 |
| May 20, 1988 | [JP] | Japan | 63-123694 |

[51] Int. Cl.[6] ..... B41M 5/035; B41M 5/38

[52] U.S. Cl. ..... 503/227; 428/195; 428/447; 428/913; 428/914

[58] Field of Search ..... 428/195, 447, 913, 914; 503/227

[56] References Cited

U.S. PATENT DOCUMENTS

| | | | |
|---|---|---|---|
| 4,626,256 | 12/1986 | Kawasaki et al. | 8/471 |
| 4,720,480 | 1/1988 | Ito et al. | 503/227 |
| 4,990,485 | 2/1991 | Egashira et al. | 503/227 |

FOREIGN PATENT DOCUMENTS

| | | | |
|---|---|---|---|
| 0212394 | 10/1985 | Japan | 503/227 |
| 1106293 | 3/1986 | Japan | 503/227 |
| 1177289 | 8/1986 | Japan | 503/227 |
| 61-244589 | 10/1986 | Japan | 503/227 |
| 62-16191 | 1/1987 | Japan | 503/227 |
| 62-2011290 | 9/1987 | Japan | 503/227 |
| 2201291 | 9/1987 | Japan | 503/227 |

*Primary Examiner*—B. Hamilton Hess

*Attorney, Agent, or Firm*—Parkhurst, Wendel & Rossi

[57] ABSTRACT

An image-receiving sheet, including a sheet substrate, an image-receiving layer which is formed on said substrate and which receives the dye migrated by heating from a heat transfer sheet and a release layer formed on said image-receiving layer, characterized in that said release layer is formed with a releasable resin having a molecular weight of 3500 to 20000.

17 Claims, No Drawings

IMAGE RECEIVING SHEET

This application is Rule 60 Divisional application of U.S. Ser. No. 07/943,474, filed Sep. 11, 1992, now U.S. Pat. No. 5,362,701, which in turn is a continuation of U.S. Ser. No. 07/614,213, filed Nov. 15, 1990, now U.S. Pat. No. 5,166,127, which in turn is a divisional application of U.S. Ser. No. 07/320,623, filed Mar. 8, 1989, now U.S. Pat. No. 4,992,413.

BACKGROUND OF THE INVENTION

This invention relates to an image-receiving sheet having excellent releasability.

An image-receiving sheet is superposed on a heat transfer sheet having a heat transfer layer during heat transfer recording, and when heat corresponding to the image information is applied from the heat transfer sheet side by a heating means such as a thermal head, there has been the problem that releasability from the heat transfer sheet is impaired for such reason as the occurrence of thermal fusion between the heat transfer layer and the image-receiving sheet.

For this reason, the image-receiving sheet of the prior art, for ensuring good releasability from the heat transfer sheet during heat transfer recording, for example, had an image receiving layer formed with a release agent generally incorporated in the resin for formation of the image-receiving layer. This imparted releasability to the image-receiving sheet by permitting the release agent to bleed onto the surface side of the image-receiving layer after coating of a resin composition for formation of the image-receiving layer containing the release agent, thereby consequently forming the release agent layer on the surface of the image-receiving layer.

However, since the release agent used for formation of the release agent layer as described above comprises a resin having a molecular weight of less than 3500, although compatibility with the resin for formation of the image-receiving layer may be relatively good, a long time and high temperature heating treatment is required for formation of a release layer by permitting the release agent to bleed sufficiently onto the surface, and yet the bled state of the release agent layer may sometimes be insufficient, therefore making the release effect of the mold release agent layer still insufficient.

SUMMARY OF THE INVENTION

The present invention has been accomplished in view of the above points, and its object is to provide an image-receiving sheet which can form a layer with good efficiency and yet provide a release layer with an excellent release effect.

The image receiving sheet of the present invention is an image-receiving sheet comprising a sheet substrate, an image-receiving layer which is formed on said substrate and which receives the dye migrated by heating from a heat transfer sheet and a release layer formed on said image-receiving layer, characterized in that said release layer is formed with a releasable resin having a molecular weight of 3500 to 20000.

DETAILED DESCRIPTION OF THE INVENTION

As the sheet substrate in the present invention, plastic films, synthetic papers, cellulose fiber papers, etc., may be employed. As the plastic film, films comprising polyester, polyvinyl chloride, polypropylene, polyethylene, polycarbonate, polyamide, etc. can be used, and white films formed with the addition of a filler or foamed films formed with fine foaming also can be used.

As the synthetic paper, those prepared by extruding a mixture of a polyolefin resin or other synthetic resins as the resin component with the addition of an inorganic filler thereto, or those prepared by coating the surface of a film such as of polystyrene resin, polyester resin or polyolefin resin with an extender pigment may be employed. As the cellulose fiber paper, wood-free paper, coated paper, cast coated paper, or papers impregnated with synthetic rubber latex or synthetic resin emulsion, etc. can be used.

In the case where transparency is required for overhead projector use or the like, a transparent substrate may be used.

As the above transparent substrate, a sheet which has been made to have a heat shrinkage of 2 to −1%, preferably 1.5 to 0%, by heating a thermoplastic resin sheet to the softening temperature or higher under a state of no tension, may be employed. The above heat shrinkage of the substrate is the shrinkage in the flow direction and the width direction of the sheet, when the sheet is heated to the softening temperature or higher. As the above thermoplastic resin, those having high transparency are preferred, including polyethylene terephthalate, polyolefin, polyvinyl chloride, polyvinylidene chloride, polystyrene, polycarbonate, polyphenylene sulfone, polyether sulfone, polyetherimide, polyarylate or acrylic resins such as polymethyl methacrylate, and preferably those having high heat resistance in particular. Generally, polyethylene terephthalate may be used. The transparent substrate should preferably have a thickness of 5 to 200 μm, particularly 30 to 150 μm.

The haze value of the transparent image-receiving layer is a value measured by a hazemeter (NDH-1001DP, manufactured by Nippon Denshoku Kogyo K.K., Japan) based on JIS K-7105. An image-receiving layer with this value being 5 or less is substantially free from haze and has an excellent transparency. If the haze value is 5 or less, the haze value of the image-receiving layer as a whole by use of the transparent substrate, also becomes 5 or less.

In the case of uses requiring transparency of the sheet substrate (for overhead projector, etc.) or uses in which transfer is effected with heat onto articles, such as card or cloth, on the side of the transparent plastic film opposite to the image-receiving layer, a support coated with an adhesive, etc. or a white film, a foamed film, a synthetic paper or a cellulose fiber paper also can be plastered as the material for imparting a shielding property. Furthermore, a sheet substrate obtained by mutually plastering together plastic films, synthetic papers or cellulose fiber papers can be used.

When the adhesive force between the sheet substrate and the image-receiving layer is poor, it is desirable that the surface of the sheet substrate have primer treatment or corona treatment etc. applied.

The image-receiving layer receives the dye migrated from the heat transfer sheet during heat transfer, and is constituted of a resin for formation image-receiving layer capable of receiving said dye. As the resin for formation of the layer, for example, the synthetic resins from (a) to (e) shown below may be used either individually or as a mixture of two or more kinds:

(a) those having ester bonds:

polyester resin (other than those modified with phenyl), polyacrylate resin, polycarbonate resin, polyvinyl acetate resin, styrene-acrylate resin, vinyl toluene-acrylate resin, etc.;

(b) those having urethane bonds:
polyurethane resin, etc.;

(c) those having amide bonds:
polyamide resin (nylon), etc.;

(d) those having urea bonds:
urea resin, etc.;

(e) those having other types of bonds with high polarity:
polycaprolactone resin, polystyrene resin, polyvinyl chloride resin, polyacrylonitrile resin, etc.

Otherwise, a mixed resin of a saturated polyester and a vinyl chloride/vinyl acetate copolymer may be used as the resin for formation of the image-receiving layer. The vinyl chloride/vinyl acetate copolymer may be preferably one containing 85 to 97% by weight of the vinyl chloride component and having a polymerization degree of about 200 to 800. The vinyl chloride/vinyl acetate copolymer is not necessarily limited to a copolymer consisting only of a vinyl chloride component and a vinyl acetate component, but may also contain a vinyl alcohol component, a maleic acid component, or the like.

The release layer is formed on the image-receiving layer surface by coating an ink composition for formation of an image-receiving layer prepared by kneading a releasable resin with a resin for formation of image-receiving layer, etc. on a sheet substrate, and permitting the releasable resin to bleed onto the surface. The release layer in the present invention is formed by use of a releasable resin having a molecular weight of 3500 to 20000, preferably 5000 to 15000. By use of a mold-releasable resin with a molecular weight of 3500 or more, compatibility with the resin for formation of image-receiving layer is made smaller to improve the bleeding characteristic, whereby it becomes possible to improve the state of bleeding of the releasable resin onto the surface, consequently giving a mold release layer with an excellent release effect to appear sufficiently on the image-receiving layer surface. On the other hand, when the above molecular weight exceeds 20000, it is difficult for the releasable resin to be compatible with the resin for formation of the image-receiving layer, thereby making it difficult to prepare the ink composition.

As the releasable resin, a releasable resin of the reaction curing type a releasable resin of the catalyst curing type or a releasable resin having a long chain alkyl group (carbon number: $n \geqq 16$) as a part of the side chains can be used.

Examples of the releasable resin of the reaction curing type may include modified silicone oils having reactive groups as mentioned below:

(a) amino-modified silicones having amino groups:

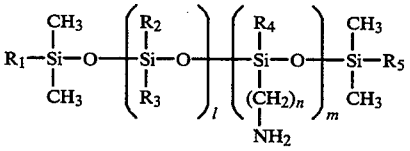

-continued

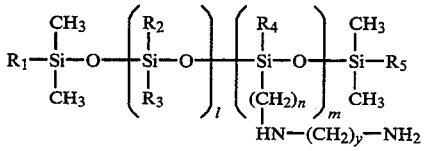

(b) epoxy modified silicones having epoxy groups:

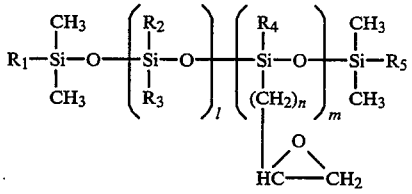

(c) modified silicones having other reactive groups: modified silicones represented by the following formula and determined by the reactive group: $R_6$.

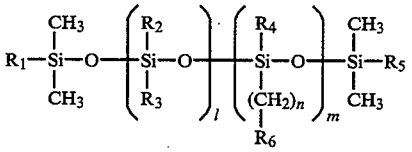

In the above formulae (structural formulae) of the above (a)–(c), $R_1$–$R_5$ represent organic groups, primarily constituted of methyl groups, but they may also be alkyl groups other than methyl or phenyl groups. l, m, n, x and y represent integers of 1 or more suitably set depending on the molecular weight of the mold releasable resin. The atomic groups at the moieties for l and m are randomly copolymerized.

The silicones as described above, are used in suitable combination depending on the reaction mode for reaction curing. This reaction mode is when the modified silicone having amino group or hydroxy group reacts with a modified silicone having epoxy group, isocyanate group or carboxyl group, respectively.

As the catalyst curing type, the two types of silicones of (d) and (e) shown below may be employed:

(d) alcohol-modified silicones, which can be subjected to dehydrating polymerization reaction through the two silicones:

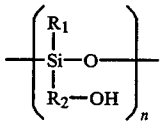

(catalyst . . . titanate, carboxylate of zinc, iron, tin, etc.)

(e) those comprising vinyl-modified silicone and vinyl-modified silicone with a part of the organic groups being —H:

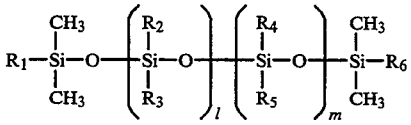

(catalyst . . . metal catalyst such as platinum type, etc.)

In the above formulae (structural formulae) of (d)-(e), $R_1$-$R_6$ represent organic groups, primarily constituted of methyl groups, which may also be alkyl groups other than methyl or phenyl groups. However, in the case of vinyl-modified silicone in (e), either a part of $R_1$-$R_6$ is vinyl group (—CH=$CH_2$), while in the case of silicone or vinyl-modified silicone when a part of the organic groups is —H, either a part of $R_1$-$R_6$ is vinyl group. Particularly, in the case of vinyl-modified silicone, at least one of $R_1$-$R_6$ is vinyl group in place of its —H. n, l, m represent integers of 1 or more suitably set depending on the molecular weight of the releasable resin. The atomic groups at the moieties for l and m are randomly copolymerized.

Furthermore, as the releasable resin having a long chain alkyl group (carbon number: n≧16) as a part of the side chains, the following chain polymers (f)-(i) may be employed.

(f) releasable resin comprising a polyolefinic chain polymer:

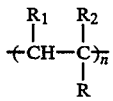

(g) releasable resin comprising a polyester type chain polymer:

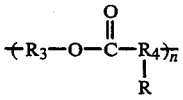

(h) releasable resin comprising a polyurethane type chain polymer:

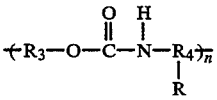

(i) releasable resin comprising a polyamide type chain polymer:

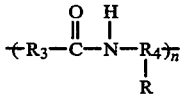

In the above formulae (structural formulae) (f)-(i), R represents a long chain alkyl group of R=—$(CH_2)_n$—$CH_3$ (n≧16). At least one of $R_1$ and $R_2$ is a reactive group, otherwise showing —H or organic group of alkyl group, and $R_3$ and $R_4$ represent aliphatic or aromatic chains having reactive groups. n represents an integer of 1 or more which may be suitably set depending on the molecular weight of the releasable resin.

The amount of the releasable resin added may be preferably 0.5 to 20% by weight, set on the basis of the resin for formation of image-receiving layer.

In the present invention, in order that a release layer having an excellent release effect can be obtained along with formation at good efficiency, assuming the molecular weight conditions as mentioned above, it can be easily accomplished by use of a releasable resin to which the following conditions are added.

(1) To use a resin having localized reactive groups.

More specifically a releasable resin having reactive groups locally present at one terminal end, both terminal ends or the central part in the main chain and a releasable resin having reactive groups randomly present at indefinite positions in the main chain are used in combination. By this, a fast release layer with a remarkably excellent release effect when compared with the release layer formed of only a release resin having reactive groups randomly present can be obtained. In the following, description is made by referring to the embodiments in which the reaction groups are permitted to be locally present at, for example, one terminal end or the central part.

First, the embodiments having reactive groups locally present in a releasable resin comprising a reacting curing type or catalyst curing type silicone:

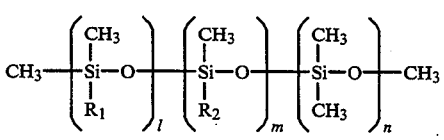

(*1)

(a) the case when localized at one terminal end:
$R_1$ is reactive group, 1≦l≦10, m+n≧20, $R_2$=methyl group alkyl group other than methyl or phenyl group;

(b) the case when localized at central part:
$R_2$ is reactive group, 1≦m≦10, l≧5, n≧5, l+n≧20, $R_1$=methyl group, alkyl group other than methyl or phenyl group.

Here, the reactive group may be an amino group, epoxy group, isocyanate group carboxyl group, hydroxyl group, vinyl group, etc. However, when the reactive group is a vinyl group, a silicone having —H or hydroxyl group at the position of organic group is used in combination.

The embodiment in which the reactive groups are localized in the releasable resin comprising a chain polymer having a long alkyl group as a part of the side chains:

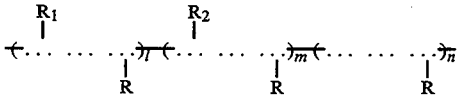

wherein, the above (... ... ...) is an abbreviation indicating the main chain portion in the chain polymers of the above (f)-(i), and R represents —$(CH_2)_nCH_3$ (n≧16):

(a) the case when localized at one terminal end:
$R_1$ is reactive group, 1≦l≦10, m+n≧20, $R_2$=H;

(b) the case when localized at the central part:
$R_2$ is reactive group, 1≦m≦10, l≧5, n≧5, l+n≧20, $R_1$-H, Here, the reactive group is a reactive group bonded to the aliphatic or aromatic chain.

(2) In the case of a reaction curing type or catalyst curing type releasable resin, the resin is made to have a substituent with good compatibility with the resin for formation of image-receiving layer.

That is, a releasable resin having a substituent with good compatibility with the resin for formation of image-receiving layer is used. In the releasable resin, since compatibility with the resin for formation of image-receiving layer is particularly influenced by the kind and amount of organic groups other than the reactive groups, these organic groups can be replaced with substituents with good compatibility with the resin for formation of the image-receiving layer. Accordingly, depending on the kind of resin for formation of the image-receiving layer, a substituent with good compatibility with said resin is selected and a releasable resin having this substituted for organic groups at a predetermined ratio is used. By doing so, in preparing the ink composition for formation of the image-receiving layer, compatibility of the releasable resin with the ink composition in the resin for formation of the image-receiving layer becomes better, whereby the releasable resin becomes readily compatible uniformly with the resin for formation of the image-receiving layer. As the result, the release layer obtained by forming with the use of an ink composition for formation of the image-receiving layer in which the releasable resin is uniformly kneaded can also be formed as a uniform layer, whereby the release effect can also be exhibited uniformly over the whole layer without variance.

As an example of the above embodiment, the case when a polyester resin is used as the resin for formation of image-receiving layer and a silicone type releasable resin used together therewith.

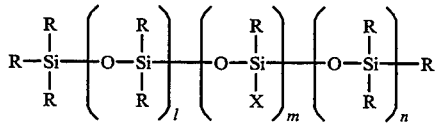

In the above formula, X represents a reactive group comprising an amino group, epoxy group, carboxyl group, hydroxyl group or vinyl group. R represents an organic group comprising a methyl group or alkyl group other than methyl. l, m, n represent integers, and the atomic groups at the moieties for l, m and n are randomly copolymerized.

Here, for the polyester resin, for example a phenyl group is a substituent with good compatibility, and therefore a part of R is substituted with the phenyl group. The ratio of the phenyl group substituted may be, when R is a methyl group, methyl/phenyl=95-5/5-95, preferably 70-20/30-80.

As described above, by use of a releasable resin having a substituent with good compatibility with the resin for formation of image-receiving layer, compatibility between the releasable resin and the resin for formation of image-receiving resin in the ink composition for formation of image-receiving layer can be improved to elongate the pot life of the ink composition, whereby no separation will occur.

(3) In the case of a releasable resin of the reaction curing type, the reactive group equivalent is lowered, or reactive groups with different equivalents are combined.

That is, a releasable resin with a reactive group equivalent (=molecular weight/number of reactive groups per one molecule) of 300 or less, preferably 100 to 250 is used. By doing so, the number of the reactive groups possessed by the releasable resin is increased, whereby the reactivity of the releasable resin during formation of the release layer can be improved, resulting in a release layer firmly cured within a short time.

Also, of the two kinds of the reaction curing type releasable resins, at least one is used as a releasable resin comprising two or more different reactive group equivalents. By doing so, the reactivity of the releasable resin during formation of the release layer can be remarkably improved, resulting in a release layer that is firmly cured within a short time. Here, as the combination embodiment of the two kinds of the releasable resin to be used in formation of release layer, when two kinds of the reaction curing type of A, B are to be used, i) a resin with one kind of reactive equivalent for A, and a resin with two or more different reaction equivalents for B may be used in combination;
ii) a resin with one kind of reactive equivalent for B, and a resin with two or more different reaction equivalents for A may be used in combination; or
iii) resins with two or more different reaction equivalents for both A and B may be used in combination.

In forming the image-receiving layer and the mold release layer, an ink composition for formation of an image-receiving layer prepared the resin for formation of the image-receiving layer and the releasable resin by use of a solvent and the ink composition, is coated and dried by the printing method or a coating method known in the art, on a sheet substrate, whereby an image-receiving layer and a release layer positioned at the surface thereof can be formed. The thickness of the image-receiving layer may preferably be about 2 to 20 μm.

The image-receiving sheet of the present invention may also have an intermediate layer comprising a cushioning layer, a porous layer, etc. provided between the sheet substrate and the image-receiving layer. By provision of such an intermediate layer, the noise becomes smaller and an image corresponding to the image information can be recorded by heat transfer with good reproducibility. The material constituting the intermediate layer may include, for example, urethane resin, acrylic resin, ethylenic resin, butadiene rubber, or epoxy resin. The thickness of the intermediate layer may preferably be about 2 to 20 μm.

Also, the image-receiving sheet of the present invention can have antistatic treatment applied to the front or back surface thereof. Such antistatic treatment may be carried out by incorporating an antistatic agent in, for example, the image-receiving layer which becomes the front surface or as the antistatic preventive layer on the image-receiving surface, and similar treatment can also be effected on the back surface. By such treatment, mutual sliding between the image-receiving sheets can be smoothly performed, and there is also the effect of preventing the attachment of dust on the image-receiving sheet.

Furthermore, the image-receiving sheet can also have a lubricating layer provided on the back surface of the sheet substrate. The material for the lubricating layer may include methacrylate resins such as of methyl methacrylate, etc. or corresponding acrylate resins, vinyl resins such as vinyl chloride-vinyl acetate copolymer.

Furthermore, the image-receiving sheet can also have detection marks provided at predetermined places. Detection marks are very convenient for performing registration between the heat transfer sheet and the image-receiving sheet, etc. and, for example, detection marks detectable by a photoelectric tube detector can be provided on the back surface of the sheet substrate by way of printing.

The present invention is described in more detail below by referring to Examples.

EXAMPLE 1

By use of a synthetic paper (Yupo KPG 150, manufactured by Oji Yuka, Japan) with a thickness of 150 μm as the substrate sheet, an ink composition for formation of an image-receiving layer as shown below, was coated by wire bar coating on the substrate to a thickness of 5 μm, and dried to form an image-receiving layer and a release layer, thus preparing an image-receiving sheet. The release layer was formed by heating treatment at 130° C. for 5 minutes.

| Ink composition for formation of image-receiving layer | |
|---|---|
| Resin for formation of image-receiving layer: | |
| Polyester resin (Vylon 600, manufactured by Toyobo, Japan) | 40 parts by weight |
| Vinyl chloride-vinyl acetate copolymer (Denkavinyl #1000A) | 60 parts by weight |
| Releasable resin: | |
| Amino-modified silicone (molecular weight = 3600) (manufactured by Shinetsu Kagaku Kogyo, Japan: X-22-3050C) | 2 parts by weight |
| Epoxy-modified silicone (molecular weight = 6800) (manufactured by Shinetsu Kagaku Kogyo, Japan: X-22-3000T) | 2 parts by weight |
| Solvent (methyl ethyl ketone/toluene = 1/1) | 400 parts by weight |

On the other hand, the heat transfer sheet to be used in combination with the above image-receiving sheet was prepared as described below.

On one surface of a polyethylene terephthalate sheet with a thickness of 4.5 μm was coated by wire bar an ink composition for formation of heat transfer layer with the composition shown below (coated amount on drying of about 1.0 g/m$^2$), followed by drying in hot air, to form a heat transfer layer, thus obtaining a heat transfer sheet.

| Ink composition for formation of heat transfer layer | |
|---|---|
| Disperse dye (Kayaset Blue 714, manufactured by Nippon Kayaku, Japan) | 7 parts by weight |
| Polyvinyl butyral resin (BX-1, manufactured by Sekisui Kagaku, Japan) | 35 parts by weight |
| Solvent (methyl ethyl ketone/toluene = 1/1) | 90 parts by weight |

The image-receiving sheet and the heat transfer sheet obtained above were superposed so that the image-receiving layer was brought into contact with the heat transfer layer, and image formation was effected by a thermal head from the heat transfer sheet side under the printing conditions of output: 1 w/dot, pulse width: 0.3–0.45 m.sec, dot density: 6 dots/mm.

As the result, the image-receiving sheet was found to have excellent releasability from the heat transfer sheet during printing. Also, the release layer in the image-receiving sheet had an excellent bleeding characteristic for the releasable resin during formation, with the releasable resin being formed sufficiently and exposed on the surface of the image-receiving layer.

Comparative Example 1

An image-receiving sheet was prepared as described in Example 1 except for changing the releasable resins to an amino-modified silicone with a molecular weight of 2500 (KF 393) and an epoxy-modified silicone with a molecular weight of 2000 (X-22-343), and then image formation was effected by use of the same heat transfer sheet under the same conditions as in Example 1. As the result, the image-receiving sheet was found to be inferior in releasability from the heat transfer sheet as compared with Example 1. Also, during formation of the release layer heating treatment at 130° C. for 12 minutes, was required for permitting the releasable resin to bleed sufficiently.

As described above, the image-receiving sheet of the present invention, which is formed of a release layer comprising a releasable resin having a molecular weight of 3500 to 20000, has its bleeding characteristic improved after coating of the ink composition for formation of image-receiving layer in which said mold releasable resin is kneaded to give a mold release layer with the releasable resin sufficiently exposed on the surface at normal temperature within a short time, and yet the release layer itself has excellent mold release effect, consequently having excellent releasability from the heat transfer sheet particularly during printing, etc.

Also, according to the present invention, by providing an intermediate layer between the sheet substrate and the image-receiving layer, heat transfer with good reproducibility is made possible.

EXAMPLE 2

By use of a synthetic paper (Yupo KPG 150, manufactured by Oji Yuka, Japan) with a thickness of 150 μm as the substrate sheet, an ink composition for formation of an image-receiving layer as shown below, was coated by wire bar coating onto the substrate to a thickness of 5 μm, and dried to form an image-receiving layer and a release layer, thus preparing an image-receiving sheet. The release layer was formed by heating treatment at 130° C. for 5 minutes.

| Ink composition for formation of image-receiving layer | |
|---|---|
| Resin for formation of image-receiving layer: | |
| Polyester resin (Vylon 600, manufactured by Toyobo, Japan) | 30 parts by weight |
| Vinyl chloride-vinyl acetate copolymer (VAGH, manufactured by UCC) | 70 parts by weight |
| Releasable resin: | |
| Amino-modified silicone (amino group equivalent = 200) (manufactured by Shinetsu Kagaku Kogyo, Japan: X-22-3050C) | 2 parts by weight |
| Epoxy-modified silicone (epoxy group equivalent = 200) | 2 parts by weight |

-continued

| Ink composition for formation of image-receiving layer | |
|---|---|
| (manufactured by Shinetsu Kagaku Kogyo, Japan: X-22-3000E) | |
| Solvent (methyl ethyl ketone/toluene = 1/1) | 400 parts by weight |

On the other hand, the heat transfer sheet to be used in combination with the above image-receiving sheet was prepared as described in Example 1.

The image-receiving sheet and the heat transfer sheet obtained above were superposed so that the image-receiving layer contacted the heat transfer layer, and image formation was effected by a thermal head from the heat transfer sheet side under the printing conditions of output: 1 w/dot, pulse width: 0.3–0.45 m.sec, dot density: 6 dots/mm.

As the result, the image-receiving sheet was found to be also excellent in releasability from the heat transfer sheet during printing.

Comparative Example 2

An image-receiving sheet was prepared as described in Example 2 except for changing the releasable resins to 2 parts by weight of an amino-modified silicone (KF 393) with a silicone exceeding 350 of the reactive group equivalent, namely an amino group equivalent of 440 and an epoxy-modified silicone (X-22-343) with an epoxy group equivalent of 350, and then image formation was effected by use of the same heat transfer sheet under the same conditions as in Example 1. As the result, the image-receiving sheet was found to be inferior in releasability from the heat transfer sheet when compared with Example 1. Also, during formation of the release layer, heating treatment for a longer time was required when compared with the sheet of Example 2 for permitting the releasable resin to bleed sufficiently.

As described above, the image-receiving sheet of the present invention, which is formed of a release layer comprising a releasable resin having a reactive group equivalent of 300 or less, can give a release layer excellent in release effect cured firmly by the reaction within a short time, and consequently having the effect of excellent releasability from the heat transfer sheet during printing in particular.

EXAMPLE 3

By use of a synthetic paper (Yupo KPG 150, manufactured by Oji Yuka, Japan) with a thickness of 150 μm as the substrate sheet, an ink composition for formation of image-receiving layer as shown below, was coated by wire bar coating on the substrate to a thickness of 5 μm, and dried to form an image-receiving layer and a release layer, thus preparing an image-receiving sheet. The release layer was formed by heating treatment at 130° C. for 3 minutes.

| Ink composition A for formation of image-receiving layer | |
|---|---|
| Resin for formation of image-receiving layer: | 100 parts by weight |
| Polyester resin (Vylon 600, manufactured by Toyobo, Japan) | |
| Releasable resin (an example in which reactive groups are locally present at one terminal end): | |
| Amino-modified silicone | 5 parts by weight |

-continued

| Ink composition A for formation of image-receiving layer | |
|---|---|
| (amino-modified silicone of the above formula *1 wherein $R_1 = —NH—(CH_2)_2—NH_2$, $R_2 = —CH_3$, $l = 10$, $m + n = 50$) | |
| Epoxy-modified silicone (manufactured by Shinetsu Kagaku Kogyo, Japan: X-22-3000E) | 2 parts by weight |
| Solvent (methyl ethyl ketone/toluene = 1/1) | 400 parts by weight |

On the other hand, the heat transfer sheet to be used in combination with the above image-receiving sheet was prepared as described in Example 1.

The image-receiving sheet and the heat transfer sheet obtained above were superposed so that the image-receiving layer contacted the heat transfer layer, and image formation was effected by a thermal head from the heat transfer sheet side under the printing conditions of output: 1 w/dot, pulse width: 0.3–0.45 m.sec, dot density: 6 dots/mm.

As the result, none of the 100 image-receiving sheets of Example 3 were thermally fused with the heat transfer sheet by heat transfer recording, and therefore the image-receiving sheet was found to have excellent in mold releasability from the heat transfer sheet during printing.

EXAMPLE 4

In preparing the image-receiving sheet, Example 3 was repeated except that an ink composition B as shown below was used in place of the ink composition A for forming image-receiving layer, and image formation was effected by heat transfer with the use of the same heat transfer sheet.

As the result, the image-receiving sheet was found to also have excellent releasability from the heat transfer sheet during printing.

| Ink composition B for formation of image-receiving layer<br>Resin for formation of image-receiving layer: | |
|---|---|
| Polyester resin (KA1039U18, manufactured by Arakawa Kagaku, Japan) | 100 parts by weight |
| Releasable resin (an example having reactive groups localized at the central portion) | 5 parts by weight |
| (amino-modified silicone of the above formula *1, wherein $R_2 = —(CH_2)_4—\overset{\overset{O}{/\backslash}}{CH}—CH_2$, $R_1 = —CH_3$, $l = 20$, $m = 10$, $n = 30$) | |
| Amino-modified silicone (X-22-3050C, manufactured by Shinetsu Kagaku Kogyo, Japan) | 2 parts by weight |
| Solvent (methyl ethyl ketone/toluene = 1/1) | 400 parts by weight. |

Comparative Example 3

An image-receiving sheet was prepared as described in Example 3 except for using 5 parts by weight of an amino-modified silicone in general with the amino groups arranged at random positions relative to the main chain (KF 393, produced by Shinetsu Kagaku, Japan) and 2 parts by weight of an epoxy-modified silicone in general with epoxy groups being arranged at random positions relative to the main chain (X-22-343, manufactured by Shinetsu Kagaku, Japan) as the releasable resin in the ink composition for formation of image-receiving layer of Example 3, and then image formation was effected under the same printing conditions by use of the same heat transfer sheet as in Example 3.

The image-receiving sheet was applied with the heating treatment under the conditions of 130° C. and 3 minutes in forming the release layer similarly as in Example 3, and thermal fusion occurred in 75 sheets by heat transfer recording performed by use of 100 image-receiving sheets of Comparative example 3. Thus, this image-receiving sheet was found to have inferior releasability from the heat transfer sheet when compared with Example 3.

As described above, the image-receiving sheet of the present invention, which is formed of a release layer comprising a releasable resin having reactive groups locally present at one terminal end, both terminal ends or the central part of the main chain and a releasable resin having reactive groups randomly present at indefinite positions in the main chain in combination, can give release layer more excellent in the release effect when compared with the release layer of the prior art formed only of a releasable resin in which the reactive groups are randomly present at indefinite positions in the main chain, thus consequently having the effect of excellent releasability from the heat transfer sheet, during printing in particular.

EXAMPLE 5

By use of a synthetic paper (Yupo KPG 150, manufactured by Oji Yuka, Japan) with a thickness of 150 μm as the substrate sheet, an ink composition for formation of image-receiving layer as shown below, was coated by wire bar coating on the substrate to a thickness of 5 μm, and dried to form an image-receiving layer and a release layer, thus preparing an image-receiving sheet. The pot life of the ink composition in this Example was found also to be good even after the lapse of 8 hours, and consequently, the release layer could also be formed by coating without any problem.

| Ink composition for formation of image-receiving layer | |
|---|---|
| Resin for formation of image-receiving layer: Polyester resin (KA1039U5, manufactured by Arakawa Kagaku, Japan) | 100 parts by weight |
| Releasable resin: | |
| Phenyl-modified amino-modified silicone (methyl/phenyl = 38/62) (X-22-3050C) | 9 parts by weight |
| Phenyl-modified epoxy-modified silicone (methyl/phenyl = 60/40) (X-22-3000Q) | 9 parts by weight |
| Solvent (methyl ethyl ketone/toluene = 1/1) | 400 parts by weight |

On the other hand, the heat transfer sheet to be used in combination with the above image-receiving sheet was prepared as described in Example 1.

The image-receiving sheet and the heat transfer sheet obtained above, were superposed so that the image-receiving layer contacted the heat transfer layer, and image formation was effected by a thermal head from the heat transfer sheet side under the printing conditions of output: 1 w/dot, pulse width: 0.3–0.45 m.sec, dot density: 6 dots/mm.

As the result, the image-receiving sheet was found to also have excellent releasability from the heat transfer sheet during printing.

Comparative Example 4

An image-receiving sheet was prepared as described in Example 5 except for using 9 parts by weight of an amino-modified silicone with all the organic groups comprising methyl groups (KF 303, manufactured by Shinetsu Kagaku Kogyo, Japan) and 9 parts by weight of an epoxy-modified silicone with all the organic groups comprising methyl groups (X-22-343, manufactured by Shinetsu Kagaku Kogyo, Japan) as the releasable resin in the ink composition for formation of image-receiving layer in Example 5, and then by use of the same heat transfer sheet as in Example 5, image formation was effected under the same printing conditions.

The ink composition in this Comparative example had an ink pot life such that separation occurred after 30 minutes, whereby no release layer could be formed as a uniform layer. Also, partial thermal fusion occurred between the image-receiving sheet and the heat transfer sheet-during heat transfer recording. Thus, releasability from the heat transfer sheet was inferior when compared with that of Example 5.

As described above, the image-receiving sheet, which is formed of a release layer comprising a releasable resin having substituents with good compatibility with the resin for formation of image-receiving layer, can give a resin ink composition for image-receiving layer in which the resin is homogeneously dissolved and also the release layer formed with the ink composition is formed as a uniform layer to give a release layer which is uniform over the whole layer and exhibits a good mold release effect. As a consequence, it has the effect of excellent releasability from the heat transfer sheet particularly during printing, etc.

EXAMPLE 6

By use of a synthetic paper (Yupo KPG 150, manufactured by Oji Yuka, Japan) with a thickness of 150 μm as the substrate sheet, an ink composition for formation of image-receiving layer as shown below was coated by wire bar coating on the substrate to a coated amount on drying of 1.0 g/m$^2$, and dried to form an image-receiving layer and a release layer, thus preparing an image-receiving sheet. The release layer was formed by heating treatment at 130° C. for 3 minutes.

| Ink composition for formation of image-receiving layer | |
|---|---|
| Resin for formation of image-receiving layer: Polyester resin (Vylon 290, manufactured by Toyobo, Japan) | 100 parts by weight |
| Releasable resin: | |
| Epoxy-modified silicone (epoxy group equivalent = 200) (X-22-3000E, manufactured by Kagaku Kogyo, Japan) | 2 parts by weight |
| Epoxy-modified silicone (epoxy group equivalent = 350) (X-22-343, manufactured by Kagaku Kogyo, Japan) | 7 parts by weight |
| Amino-modified silicone (amino group equivalent = 200) (X-22-3050C, manufactured by Kagaku Kogyo, Japan) | 7 parts by weight |

-continued

| Ink composition for formation of image-receiving layer | |
|---|---|
| Solvent (methyl ethyl ketone/toluene = 1/1) | 400 parts by weight |

On the other hand, the heat transfer sheet to be used in combination with the above image-receiving sheet was prepared as described in Example 1.

The image-receiving sheet and the heat transfer sheet obtained above were superposed so that the image-receiving layer was brought into contact with the heat transfer layer, and image formation was effected by a thermal head from the heat transfer sheet side under the printing conditions of output: 1 w/dot, pulse width: 0.3–0.45 m.sec, dot density: 6 dots/mm.

As the result, the image-receiving sheet was found to also have excellent releasability from the heat transfer sheet during printing.

Comparative Example 5

An image-receiving sheet was prepared as described in Example 6 except for using 12 parts by weight of an amino-modified silicone with an epoxy group equivalent of 350 (KF 393) and 12 parts by weight of an epoxy-modified silicone with an epoxy group equivalent of 350 (X-22-343) as the releasable resin in the ink composition for formation of image-receiving layer in Example 6, and then by use of the same heat transfer sheet as in Example 6, image formation was effected under the same printing conditions. As the result, the image-receiving sheet was found to have inferior releasability from the heat transfer sheet when compared with Example 6. Also, the heating treatment for formation of the release layer required 15 minutes at 130° C.

As described above, the image-receiving sheet, which is formed of a release layer comprising two kinds of releasable resin of the reaction curable type with at least one of them comprising a combination of two or more kinds of releasable resins with different reactive group equivalents, can remarkably improve the reactivity of the releasable resin to give a release layer having an excellent release effect and firmly cured by the reaction within a short time. As a consequence, it has the effect of excellent releasability from the heat transfer sheet during printing in particular.

EXAMPLE 7

On one surface of a transparent polyethylene terephthalate film (Lumilar T100, manufactured by Toray, Japan) with a thickness of 100 μm was coated the same ink composition for formation of image-receiving layer as in Example 5 to a thickness after drying of 5 μm, and the heating treatment was conducted at 130° C. for 10 minutes to obtain an image-receiving sheet for preparation of a transmissive original. It had a haze value of 1 and therefore had extremely high transparency.

EXAMPLE 8

On one surface of two kinds of transparent substrates was prepared an image-receiving sheet for preparation of transmissive original similarly as in the above Examples by use of the same ink composition for formation of an image-receiving layer as in Example 5, and image formation was effected under the same conditions to obtain the results as shown below.

| | Heat shrinkage | Curling | Color deviation |
|---|---|---|---|
| Toray Lumilar X-60 | 0.3 | None | None |
| Toray Lumilar S-60 | 2.1 | Slight | Slight |

(All are polyethylene terephthalate films having a thickness of 100 μm)

What is claimed is:

1. An image-receiving sheet for use with a heat transfer sheet having a dye layer containing a heat-transferable dye, said image-receiving sheet comprising:

a substrate; and an image-receiving layer formed on at least one side of said substrate, said image-receiving layer comprising a dye-receptive resin and a releasable resin comprising a reaction curing silicone resin having a phenyl group.

2. The image-receiving sheet according to claim 1, wherein said reaction curing silicone resin is of the following formula:

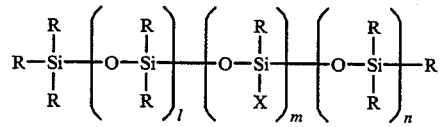

wherein

X represents a reactive group;

R represents an organic group;

l, m, n represent integers of 1 or more, and the atomic groups at the moieties for l, m and n are randomly copolymerized.

3. The image-receiving sheet according to claim 2, wherein said reaction curing silicone resin has alkyl and phenyl groups, the ratio of alkyl group/phenyl group is 95-5/5-95.

4. The image-receiving sheet according to claim 2, wherein a reaction group contained in the reaction curing silicone resin is selected from the group consisting of amino groups, epoxy groups, isocyanate groups, carboxyl groups, hydroxy groups and vinyl groups.

5. The image-receiving sheet of claim 1, wherein said releasable resin is selected from the group consisting of amino-modified silicones having amino groups and epoxy modified silicones having epoxy groups.

6. The image-receiving sheet of claim 5, wherein said releasable resin is of the formulae:

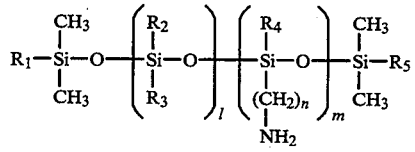

or

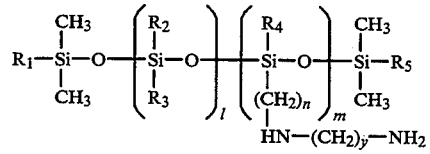

wherein $R_5$ is NCO for isocyanate-modified silicone;

$R_5$ is OH for alcohol-modified silicone;

$R_5$ is COOH for carboxyl-modified silicone; and wherein $R_1$–$R_5$ represent organic groups, l, m, n, x and y represent integers of 1 or more suitably set depending on the molecular weight of said releasable resin, and the atomic groups at the moieties for l and m are randomly copolymerized.

7. The image-receiving sheet of claim 6, wherein $R_1$–$R_5$ represent alkyl or phenyl groups.

8. The image-receiving sheet of claim 7, wherein $R_1$–$R_5$ represent methyl groups.

9. The image-receiving sheet of claim 5, wherein said releasable resin is:

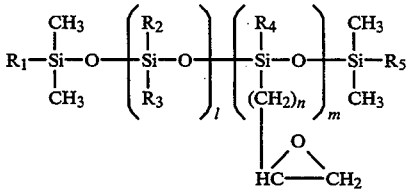

wherein $R_1$–$R_5$ represent organic groups, l, m, n, x and y represent integers of 1 or more suitably set depending on the molecular weight of said releasable resin, and the atomic groups at the moieties for l and m are randomly copolymerized.

10. The image-receiving sheet of claim 9, wherein $R_1$–$R_5$ represent alkyl or phenyl groups.

11. The image-receiving sheet of claim 1, wherein said releasable resin is:

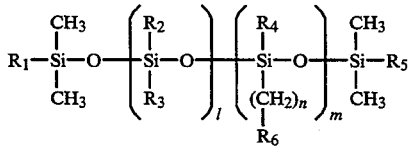

wherein $R_5$ is NCO for isocyanate-modified silicone;

$R_5$ is OH for alcohol-modified silicone;

$R_5$ is COOH for carboxyl-modified silicone; and wherein $R_1$–$R_5$ represent organic groups, l, m, n, x and y represent integers of 1 or more suitably set depending on the molecular weight of said releasable resin, and the atomic groups at the moieties for l and m are randomly copolymerized.

12. The image-receiving sheet of claim 11, wherein $R_1$–$R_5$ represent alkyl or phenyl groups.

13. The image-receiving sheet of claim 1, wherein the releasable resin bleeds toward the surface of the image-receiving layer so that the releasable rein exists abundantly in the vicinity of the uppermost surface of the image-receiving layer.

14. The image-receiving sheet of claim 13, wherein a release layer comprising the dye-receptive resin and the releasable resin is formed on the dye-receptive resin layer.

15. An image-receiving sheet for use with a heat transfer sheet having a dye layer containing a heat-transferable dye, said image-receiving sheet comprising:

a substrate;

an image-receiving layer formed on one surface of said substrate, said image-receiving layer comprising a dye-receptive resin; and a release layer formed on said image-receiving layer, said release layer comprising a releasable resin comprising a reaction curing silicone resin having a phenyl group.

16. The image-receiving sheet of claim 15, wherein said releasable resin is selected from the group consisting of:

(a) amino-modified silicones having amino groups of the formulae:

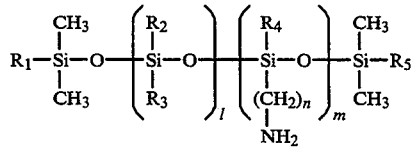

or

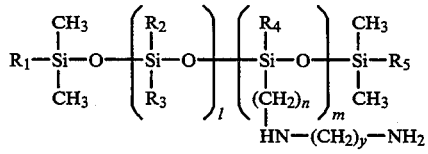

(b) epoxy-modified silicones having epoxy groups of the formula:

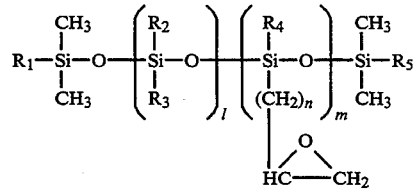

(c) modified silicones having other reactive groups of the formula:

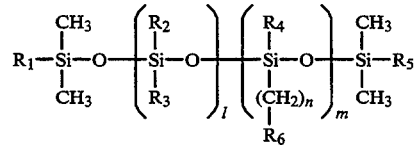

wherein $R_1$–$R_5$ represent organic groups, $R_6$ is —NCO, —OH, or —COOH, l, m, n, x and y represent integers of 1 or more suitably set depending on the molecular weight of the releasable resin, and the atomic groups at the moieties for l and m being randomly copolymerized.

17. The image-receiving sheet of claim 16, wherein $R_1$–$R_5$ represent alkyl or phenyl groups.

* * * * *